US012508477B2

(12) United States Patent
Greer et al.

(10) Patent No.: US 12,508,477 B2
(45) **Date of Patent: *Dec. 30, 2025**

(54) GOLF CLUB HEADS WITH GOLF COUPLING MECHANISMS

(71) Applicant: KARSTEN MANUFACTURING CORPORATION, Phoenix, AZ (US)

(72) Inventors: Evan R. Greer, Phoenix, AZ (US); Jacob T. Clarke, Apex, NC (US); Eric J. Morales, Laveen, AZ (US); Ryan M. Stokke, Anthem, AZ (US); Eric V. Cole, Phoenix, AZ (US); David S. Kultala, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 127 days.

This patent is subject to a terminal disclaimer.

(21) Appl. No.: 18/155,620

(22) Filed: Jan. 17, 2023

(65) Prior Publication Data

US 2023/0149781 A1 May 18, 2023

Related U.S. Application Data

(60) Division of application No. 16/945,577, filed on Jul. 31, 2020, now Pat. No. 11,554,296, which is a (Continued)

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 53/023* (2020.08); *Y10T 29/49826* (2015.01)

(58) Field of Classification Search
CPC ..... A63B 53/02; A63B 53/021; A63B 53/022; A63B 53/023; A63B 53/025;
(Continued)

(56) References Cited

U.S. PATENT DOCUMENTS 2,027,452 A 1/1936 Gunnar
2,219,670 A 10/1940 Wettlaufer
(Continued)

FOREIGN PATENT DOCUMENTS

EP 0535848 4/1993
GB 2241173 8/1991
(Continued)

OTHER PUBLICATIONS

PCT International Search Report and Written Opinion dated Apr. 20, 2010 from corresponding PCT Application No. PCT/US2009/058630.

(Continued)

*Primary Examiner* — Sebastiano Passaniti

(57) ABSTRACT

Embodiments of golf coupling mechanisms for joining golf club heads and shafts are described herein. The golf coupling mechanism allows for adjustment of a club head loft angle, a club head lie angle, and a golf club shaft length while utilizing one club head and one shaft. In a fully extended configuration, the golf coupling mechanism includes a shaft sleeve, a removable spacer, and a removable extender, wherein a fastening assembly secures the golf coupling mechanism to the golf club head. In a contracted configuration, the golf coupling mechanism includes the shaft sleeve. The golf coupling mechanism further includes a shaft cap to soften the interaction between the shaft and the golf coupling mechanism. The golf coupling mechanism further comprises one or more arcuate coupler sets to frictionally lock the shaft relative to the golf club head.

10 Claims, 13 Drawing Sheets

Related U.S. Application Data continuation-in-part of application No. 16/523,839, filed on Jul. 26, 2019, now Pat. No. 11,013,964, which is a continuation of application No. 15/831,515, filed on Dec. 5, 2017, now Pat. No. 10,398,946, which is a continuation of application No. 15/003,494, filed on Jan. 21, 2016, now Pat. No. 9,868,035, which is a continuation-in-part of application No. 14/282,786, filed on May 20, 2014, now Pat. No. 9,327,170, which is a continuation-in-part of application No. 13/795,653, filed on Mar. 12, 2013, now Pat. No. 9,168,426, and a continuation-in-part of application No. 13/735,123, filed on Jan. 7, 2013, now Pat. No. 9,192,823, and a continuation-in-part of application No. 13/468,663, filed on May 10, 2012, now Pat. No. 8,926,447, said application No. 13/735,123 is a continuation-in-part of application No. 13/468,675, filed on May 10, 2012, now Pat. No. 8,932,147, said application No. 14/282,786 is a continuation-in-part of application No. 13/468,675, filed on May 10, 2012, now Pat. No. 8,932,147, said application No. 13/735,123 is a continuation-in-part of application No. 13/468,663, filed on May 10, 2012, now Pat. No. 8,926,447, and a continuation-in-part of application No. 13/468,677, filed on May 10, 2012, now Pat. No. 8,419,567, said application No. 13/468,663 is a continuation-in-part of application No. 13/429,319, filed on Mar. 24, 2012, now Pat. No. 8,790,191, said application No. 13/468,675 is a continuation-in-part of application No. 13/429,319, filed on Mar. 24, 2012, now Pat. No. 8,790,191, said application No. 13/468,677 is a continuation of application No. 13/429,319, filed on Mar. 24, 2012, now Pat. No. 8,790,191, said application No. 14/282,786 is a continuation-in-part of application No. 13/429,319, filed on Mar. 24, 2012, now Pat. No. 8,790,191.

(60) Provisional application No. 62/881,271, filed on Jul. 31, 2019, provisional application No. 62/254,081, filed on Nov. 11, 2015, provisional application No. 62/107,240, filed on Jan. 23, 2015, provisional application No. 61/590,232, filed on Jan. 24, 2012, provisional application No. 61/529,880, filed on Aug. 31, 2011.

(58) Field of Classification Search
CPC ... A63B 53/026; A63B 53/027; A63B 53/028; A63B 53/0466
USPC ..... 473/305–315
See application file for complete search history.

(56) References Cited

U.S. PATENT DOCUMENTS 2,425,808 A 8/1947 Jay
2,962,286 A 11/1960 Brouwer
4,854,582 A 8/1989 Yamada
4,948,132 A 8/1990 Wharton
5,039,098 A 8/1991 Pelz
5,335,909 A * 8/1994 Green, Jr. ..... A63B 53/02 473/305
5,624,300 A 4/1997 Kishii
6,050,903 A 4/2000 Lake
6,368,230 B1 4/2002 Helmstetter
6,652,388 B1 11/2003 Lenhof
6,755,752 B2 6/2004 Shimizu
6,863,622 B1 3/2005 Hsu
6,890,269 B2 5/2005 Burrows
7,029,402 B2 4/2006 Nakajima
7,083,529 B2 8/2006 Cackett
7,258,623 B2 8/2007 Halleck
7,300,359 B2 11/2007 Hocknell
7,326,126 B2 2/2008 Holt
7,438,645 B2 10/2008 Hsu
D583,001 S 12/2008 Evans
D583,891 S 12/2008 Demille
D588,660 S 3/2009 Evans
7,500,920 B2 3/2009 Sugimae
D590,036 S 4/2009 Evans
D590,906 S 4/2009 Cackett
7,530,900 B2 5/2009 Holt
7,566,279 B2 7/2009 Nakashima
D614,712 S 4/2010 Toulon
7,699,717 B2 4/2010 Morris
7,722,475 B2 5/2010 Thomas
7,789,769 B2 9/2010 Sugimoto
7,819,755 B2 10/2010 Sugimae
7,846,037 B2 12/2010 Burnett
7,857,709 B2 * 12/2010 Burch ..... A63B 53/02 473/307
7,878,921 B2 2/2011 Bennett
7,887,431 B2 2/2011 Beach
7,892,105 B2 2/2011 Galloway
7,892,107 B2 2/2011 Vald'Via
7,909,706 B2 3/2011 Cole
7,922,599 B2 4/2011 Yamamoto
7,931,542 B2 4/2011 Kusumoto
7,963,855 B2 6/2011 Sander
7,963,856 B2 6/2011 Yamamoto
7,997,997 B2 8/2011 Bennett
8,075,417 B2 12/2011 Thomas
8,096,894 B2 1/2012 Sander
8,142,306 B2 3/2012 De La Cruz
8,162,774 B2 4/2012 Sato
8,177,661 B2 5/2012 Beach
8,182,358 B2 * 5/2012 Sander ..... A63B 53/0466 473/307
8,182,360 B2 5/2012 Cameron
8,192,299 B2 6/2012 Sato
8,235,834 B2 8/2012 De La Cruz
8,235,837 B2 8/2012 Bennett
8,262,498 B2 9/2012 Beach
8,262,499 B2 9/2012 Murphy
8,277,333 B2 10/2012 Thomas
8,403,770 B1 3/2013 Aguinaldo
8,419,567 B2 4/2013 Jertson
8,523,701 B2 9/2013 Knutson
8,535,173 B2 9/2013 Golden
8,574,093 B2 11/2013 Sato
8,585,511 B2 11/2013 Sato
8,636,606 B2 1/2014 Sato
8,668,597 B2 3/2014 Yamamoto
8,727,905 B2 5/2014 Murphy
8,790,191 B2 * 7/2014 Jertson ..... A63B 53/02 473/246
8,876,626 B2 11/2014 Suwa
8,926,447 B2 * 1/2015 Jertson ..... A63B 53/0466 473/246
8,926,477 B2 1/2015 Lynn
8,932,147 B2 * 1/2015 Jertson ..... A63B 53/02 473/246
9,022,879 B2 5/2015 Sato
9,033,821 B2 5/2015 Beach
9,168,426 B2 10/2015 Solheim
9,180,348 B2 11/2015 Beach
9,192,823 B2 * 11/2015 Cole ..... A63B 53/04
9,216,326 B2 12/2015 Beach
9,283,445 B2 3/2016 Moore
9,327,170 B2 * 5/2016 Solheim ..... A63B 53/0466
9,868,035 B2 * 1/2018 Clarke ..... A63B 53/0466
10,130,856 B2 11/2018 Boggs
10,137,345 B2 11/2018 Solheim
10,307,646 B2 6/2019 Mizutani
10,398,946 B2 9/2019 Clarke
10,518,149 B2 12/2019 Solheim
11,013,964 B2 * 5/2021 Clarke ..... A63B 53/02
11,554,296 B2 * 1/2023 Greer ..... A63B 53/0466

(56) References Cited

U.S. PATENT DOCUMENTS

| | | | | |
|---|---|---|---|---|
| 11,607,590 | B2 * | 3/2023 | Woodward | A63B 53/0466 |
| 12,070,660 | B2 * | 8/2024 | Clarke | A63B 53/0466 |
| 2001/0007835 | A1 | 7/2001 | Baron | |
| 2006/0287125 | A1 | 12/2006 | Hocknell | |
| 2007/0117645 | A1 | 5/2007 | Nakashima | |
| 2008/0254909 | A1 | 10/2008 | Callinan | |
| 2008/0280693 | A1 | 11/2008 | Chai | |
| 2008/0318705 | A1 | 12/2008 | Clausen | |
| 2009/0062029 | A1 | 3/2009 | Stites | |
| 2009/0233728 | A1 | 9/2009 | Liou | |
| 2010/0035700 | A1 | 2/2010 | Yu | |
| 2010/0197423 | A1 | 8/2010 | Thomas | |
| 2011/0111881 | A1 | 5/2011 | Sander | |
| 2011/0263348 | A1 * | 10/2011 | Sato | A63B 53/02 473/307 |
| 2012/0165111 | A1 | 6/2012 | Cheng | |
| 2012/0225729 | A1 * | 9/2012 | Burch | A63B 60/00 473/307 |
| 2012/0316006 | A1 | 12/2012 | Kitagawa | |
| 2013/0230654 | A1 | 9/2013 | Sargent | |
| 2016/0136487 | A1 * | 5/2016 | Clarke | A63B 53/0466 473/308 |
| 2019/0344130 | A1 | 11/2019 | Clarke | |

FOREIGN PATENT DOCUMENTS

| | | |
|---|---|---|
| JP | 2001017584 | 1/2001 |
| JP | 2003070940 | 3/2003 |
| JP | 2006042951 | 2/2006 |
| JP | 2008142338 | 6/2008 |
| JP | 2009050676 | 3/2009 |
| JP | 3154639 | 10/2009 |
| KR | 20070021382 | 2/2007 |

OTHER PUBLICATIONS

PCT International Search Report dated Mar. 18, 1988 from corresponding PCT Application No. PCT/GB87/00789.

PCT International Search Report and Written Opinion dated Nov. 23, 2006 from corresponding PCT Application No. PCT/KR2006/003260.

* cited by examiner

GOLF CLUB HEADS WITH GOLF COUPLING MECHANISMS

CROSS REFERENCE TO RELATED APPLICATIONS

This is a divisional of U.S. patent application Ser. No. 16/945,577, filed on Jul. 31, 2020, and is issued as U.S. Pat. No. 11,554,296 on Jan. 17, 2023, which claims the benefit of U.S. Provisional Patent Application No. 62/881,271, filed on Jul. 31, 2019, and is a continuation in part of U.S. patent application Ser. No. 16/523,839, filed on Jul. 26, 2019, and issued as U.S. Pat. No. 11,013,964, which is a continuation U.S. patent application Ser. No. 15/831,515, filed on Dec. 5, 2017, and is issued as U.S. Pat. No. 10,398,946 on Sep. 3, 2019, which is a continuation of U.S. patent application Ser. No. 15/003,494, filed on Jan. 21, 2016, and is issued as U.S. Pat. No. 9,868,035 on Jan. 16, 2018, which claims the benefit of U.S. Provisional Patent Application No. 62/107,240, filed on Jan. 23, 2015, and U.S. Provisional Patent Application No. 62/254,081, filed on Nov. 11, 2015, and is a continuation in part of U.S. patent application Ser. No. 14/282,786, filed on May 20, 2014, and is issued as U.S. Pat. No. 9,327,170 on May 3, 2016. U.S. patent application Ser. No. 14/282,786, filed on May 20, 2014 is a continuation in part of: (i) U.S. patent application Ser. No. 13/795,653, filed on Mar. 12, 2013, and is issued as U.S. Pat. No. 9,168,426 on Oct. 27, 2015; (ii) U.S. patent application Ser. No. 13/429,319, filed on Mar. 24, 2012, and is issued as U.S. Pat. No. 8,790,191 on Jul. 29, 2014; (iii) U.S. patent application Ser. No. 13/468,663, filed on May 10, 2012, and is issued as U.S. Pat. No. 8,926,447 on Jan. 6, 2015; (iv) U.S. patent application Ser. No. 13/468,675, filed on May 10, 2012, and is issued as 8,932,147 on Jan. 13, 2015; and (v) U.S. patent application Ser. No. 13/735,123, filed on Jan. 7, 2013, and is issued as U.S. Pat. No. 9,192,823 on Nov. 24, 2015. U.S. patent application Ser. No. 13/429,319 claims the benefit of U.S. Provisional Patent Application No. 61/590,232, filed on Jan. 24, 2012, and U.S. Provisional Patent Application No. 61/529,880, filed on Aug. 31, 2011. U.S. patent application Ser. No. 13/468,663 and U.S. patent application Ser. No. 13/468,675 each are a continuation in part of U.S. patent application Ser. No. 13/429,319, filed on Mar. 24, 2012, and is issued as U.S. Pat. No. 8,790,191 on Jul. 29, 2014. U.S. patent application Ser. No. 13/735,123, filed on Jan. 7, 2013 is a continuation in part of: (i) U.S. patent application Ser. No. 13/468,663, filed on May 10, 2012, and is issued as U.S. Pat. No. 8,926,447 on Jan. 6, 2015; (ii) U.S. patent application Ser. No. 13/468,675, filed on May 10, 2012, and is issued as 8,932,147 on Jan. 13, 2015; (iii) U.S. patent application Ser. No. 13/468,677, filed on May 10, 2012, and is issued as U.S. Pat. No. 8,419,567 on Apr. 16, 2013, which is a continuation of U.S. patent application Ser. No. 13/429,319, filed on Mar. 24, 2012, wherein the contents of all above-described disclosures are incorporated herein by reference in their entirety.

FIELD OF THE INVENTION

This invention generally relates to golf clubs. In particular, the present disclosure is related golf coupling mechanisms for joining golf club heads and shafts.

BACKGROUND

Current fitting methods require a large inventory of shafts to fit a wide variety of users. A golf club fitter evaluates a user's swing, and then selects a golf club having specifications that would best fit the user. The golf club fitter needs to have a large inventory of shafts and club heads to be able to accommodate different user's fitting dimensions. This large inventory is undesirable in the field because excess shafts or club heads take up storage space that could be used for other fitting equipment. Therefore, there is a need in the art for a golf coupling mechanism that adjusts a club head loft angle, a club head lie angle, and a golf club shaft length to reduce club head or shaft inventory size.

Figure 1:
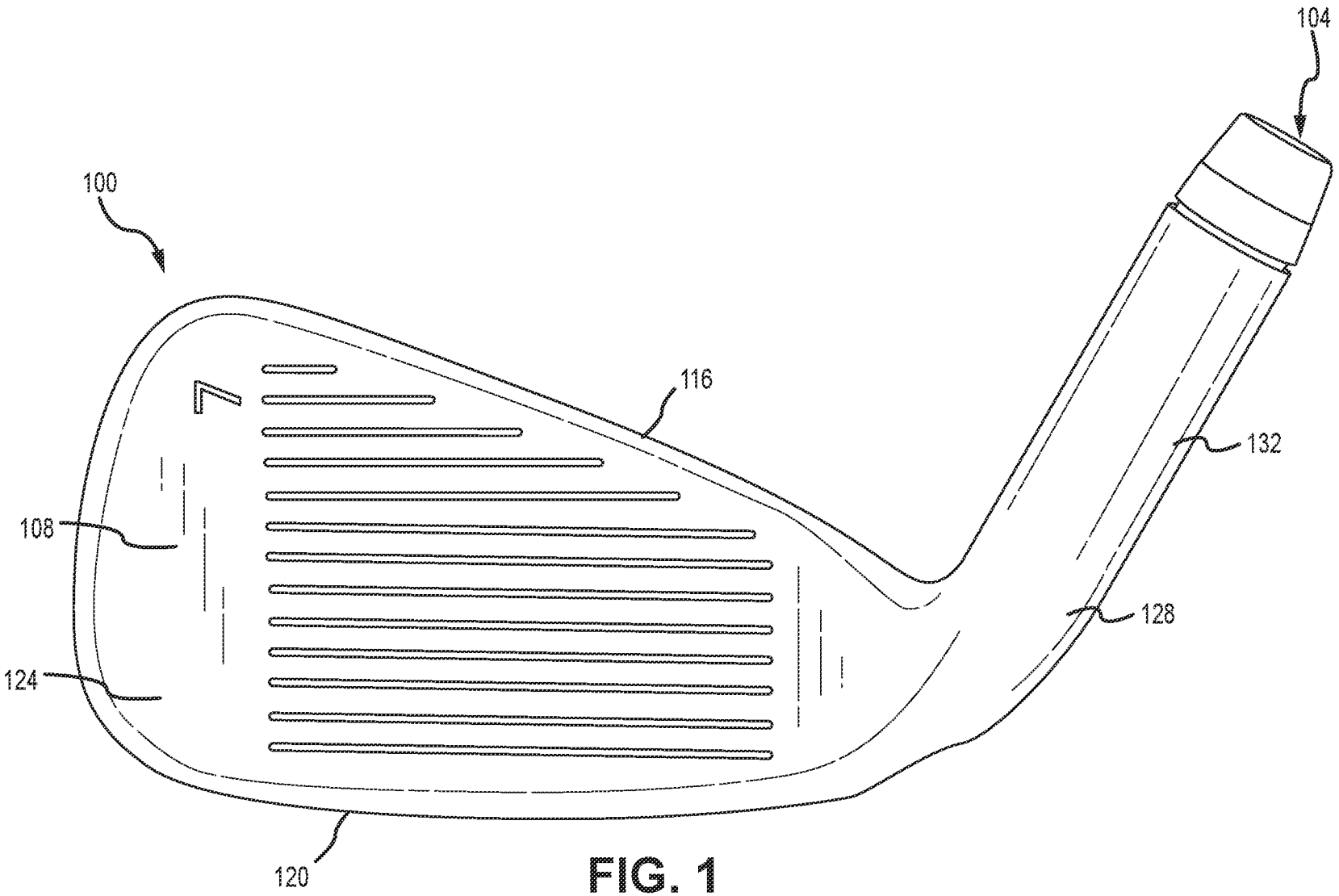
FIG. 1 illustrates a front view of a golf club head having a golf coupling mechanism.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The present embodiments discussed below are directed to a golf coupling mechanism configured for joining a golf club head to a golf club shaft. The golf coupling mechanism is disposed within a hosel having a hosel bore. The golf coupling mechanism allows for the adjustment of a club head loft angle, a club head lie angle, and a golf club shaft length while utilizing one shaft. The golf coupling mechanism utilizes an off-axis tilt in combination with an arcuate coupler set protruding from an outer surface of the golf coupling mechanism to adjust the loft angle and lie angle of the golf club. The arcuate coupler set of the golf coupling mechanism is configured to engage an arcuate receiver coupler set intended within the hosel of the golf club head. The arcuate coupler set of the golf coupling mechanism frictionally locks the shaft relative to the golf club head. The arcuate couplers ensure the golf coupling mechanism is centered within the hosel and ensures uniform contact between the golf coupling mechanism and the hosel (i.e. coupling mechanism is not misaligned within the hosel to create high areas of stress).

The golf coupling mechanism utilizes a removable spacer and removable extender to extend the length of the shaft. The golf coupling mechanism with the shaft lengthening components including the removable spacer and the removable extender accommodates a wide range of golfer's heights and/or wrist to floor dimensions. The removable spacer and the removable extender increase the length of the golf coupling mechanism thereby increasing the length of the shaft. The removable spacer and the extender are non-threadably secured to the golf coupling mechanism. The removable lengthening components of the golf coupling mechanism allows a golf fitter to use one shaft to accommodate a golf player's dimensions without the need for a large club head or shaft inventory.

The terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) can be for any length of time, e.g., permanent or semi-permanent or only for an instant.

The absence of the word "removably," "removable," and the like near the word "coupled," and the like does not mean that the coupling, etc. in question is or is not removable.

The terms "loft", "loft angle", "lie", or "lie angle" of a golf club, as described herein, refers to angles formed between the golf club and a ground plane when the golf club is held in an address position. In the address position, the lie angle of the golf club (i.e. angle formed between the shaft and the ground plane) and the loft angle of the golf club (i.e. the angled formed between the club face and the ground plane) are oriented as specified by the manufacturer, and are measured by any suitable loft and lie machine.

Embodiments of a golf club head are described herein, wherein the golf club head can comprise a hollow body club head. More specifically, the club head can be an iron, wedge, a crossover, or other iron-type club heads.

For example, the iron can comprise a loft angle less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

Further, in some embodiments, the loft angle of the iron can be greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

The iron can comprise a lie angle ranging from 50 degrees to 65 degrees. In some embodiments, the lie angle of the iron can range from 50 to 60 degrees, or 60 to 65 degrees. For example, the lie angle of the iron can be 50, 51, 52, 53, 54, 55, 56, 57, 58, 59, 60, 61, 62, 63, 64, or 65 degrees.

A volume of the iron can be greater than or equal to 20 cubic centimeters (cc) and less than or equal to 80 cubic centimeters (cc). In some embodiments, the volume of the iron can range from 20 to 50 cc, or 50 to 80 cc. In other embodiments, the volume of the iron can range from 20 to 60 cc, 30 to 70 cc, or 40 to 80 cc. For example, the volume of the iron can be 20, 30, 40, 50, 60, 70, or 80 cc.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Golf Club Head with Golf Coupling Mechanism

The present technology generally relates to an iron-type club head having a golf coupling mechanism for joining a shaft to the club head. The golf coupling mechanism reduces the size of club head inventory and/or shaft inventory by having the capability of achieving multiple loft angles, lie angles, and shaft lengths with one club head and one shaft. The golf coupling mechanism comprises a shaft sleeve, a shaft cap, and a retaining assembly to secure the golf coupling mechanism within the hosel of the club head. The shaft sleeve comprises features such as an off-axis tilt and a coupler set having a plurality of couplers to enable the golf coupling mechanism to adjust the loft and lie angle together. The coupler set of the shaft sleeve frictionally locks the shaft relative club head while providing uniform contact between the golf coupling mechanism and the hosel. The shaft cap is formed from a soft material to allow the shaft cap to elastically compress within the shaft sleeve. The shaft cap acts like a "shaft pillow" to soften the interaction between the shaft and the golf coupling mechanism. The shaft cap further comprises centering features such as ribs to center the shaft within golf coupling mechanism.

The golf coupling mechanism further comprises shaft lengthening components such as a removable spacer and a removable extender to extend the shaft length. The removable spacer and the removable extender are secured to the golf coupling mechanism without the use of threads or a threaded connection. The non-threaded connection of the removable spacer and the removable extender allow for quick removal of these components to increase or decrease the shaft length. The golf coupling mechanism described herein allows for multiple lie angle options, loft angle options, and shaft length options while utilizing a single club head and a single shaft. Described below is a first embodiment of the present technology.

Referring to the drawings, wherein like reference numerals are used to identify like or identical components in various views, FIGS. 1-15 schematically illustrates a first embodiment of the present design. Specifically, FIG. 1 illustrates a front view of a golf club head 100 having a golf coupling mechanism 104. The club head 100 includes a strikeface 108, a rear 112 opposite the strikeface 108, a top rail 116, a sole 120 opposite the top rail 116, a toe 124, a heel 128 opposite the toe 124, and a hosel 132. The heel 128 of the club head 100 can be defined as a portion of the club head 100 that is proximate to and including the hosel 132. The toe 24 of the club head 100 can be defined as a portion of the club head 100 farthest from the shaft.

Figure 2:
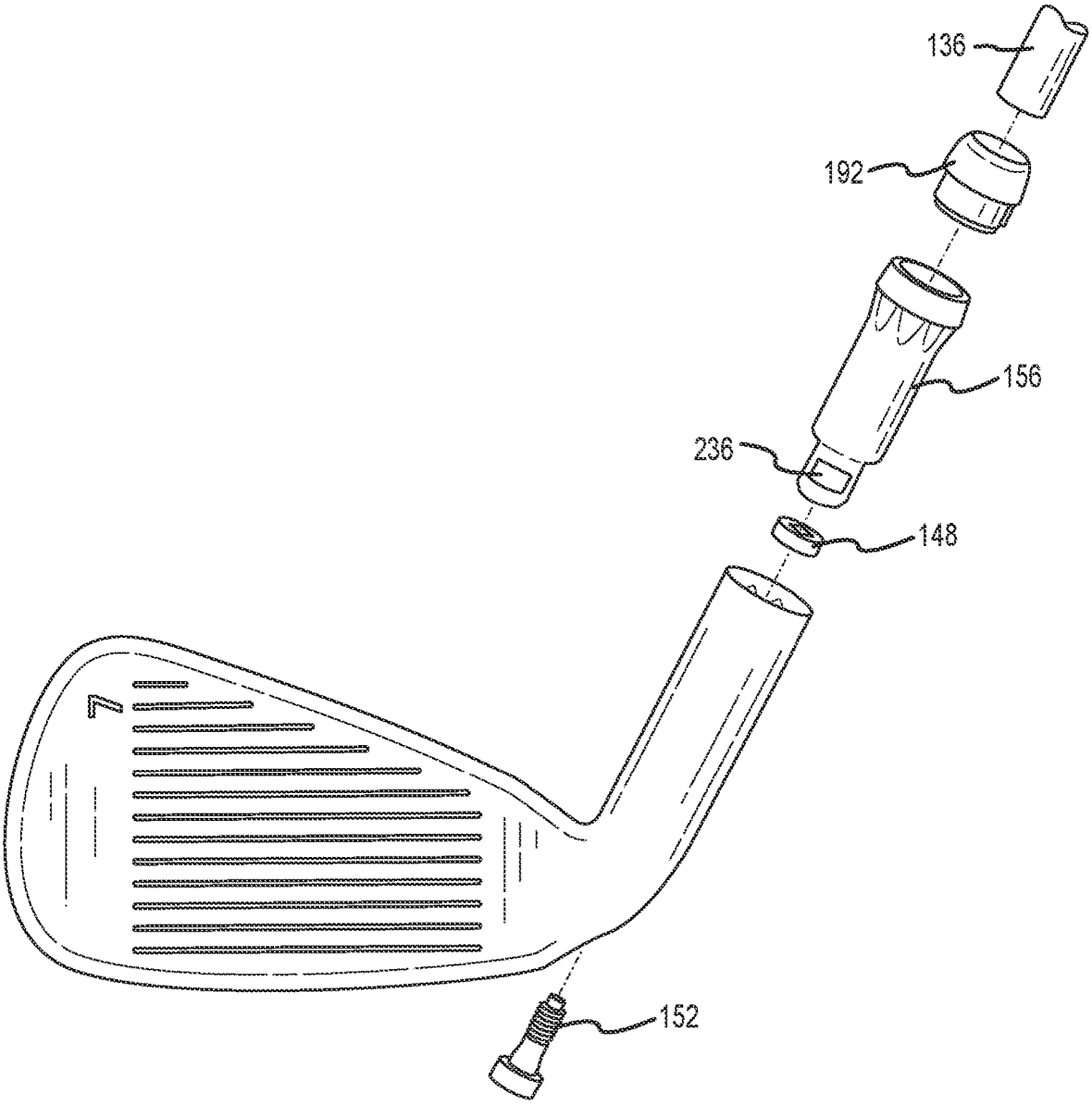
FIG. 2 illustrates an exploded view of the golf coupling mechanism of FIG. 1 for joining the golf club head to a shaft.

As illustrated in FIGS. 1 and 2, the club head 100 includes the strikeface 108 intended to impact a golf ball, and a hosel 132 intended to couple the club head 100 with a shaft 136. The hosel 132 includes a bore 140 that is configured to receive the golf coupling mechanism 104 and the shaft 136. The hosel bore 140 further includes a hosel flange 144 that is configured to receive a retaining assembly including a washer 148 and a fastener 152. The retaining assembly including the washer 148 and the fastener 152 when tighten, abuts the hosel flange 144 to secure and retain the golf coupling mechanism 104 within the hosel bore 140.

Figure 4:
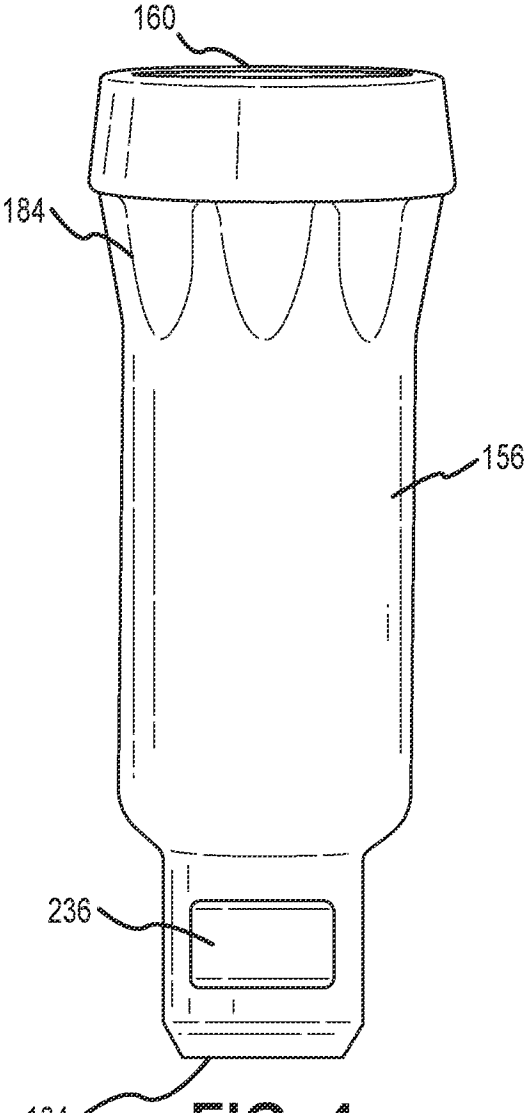
FIG. 4 illustrates a side perspective view of the shaft sleeve of the golf coupling mechanism of FIG. 1.
Figure 3:
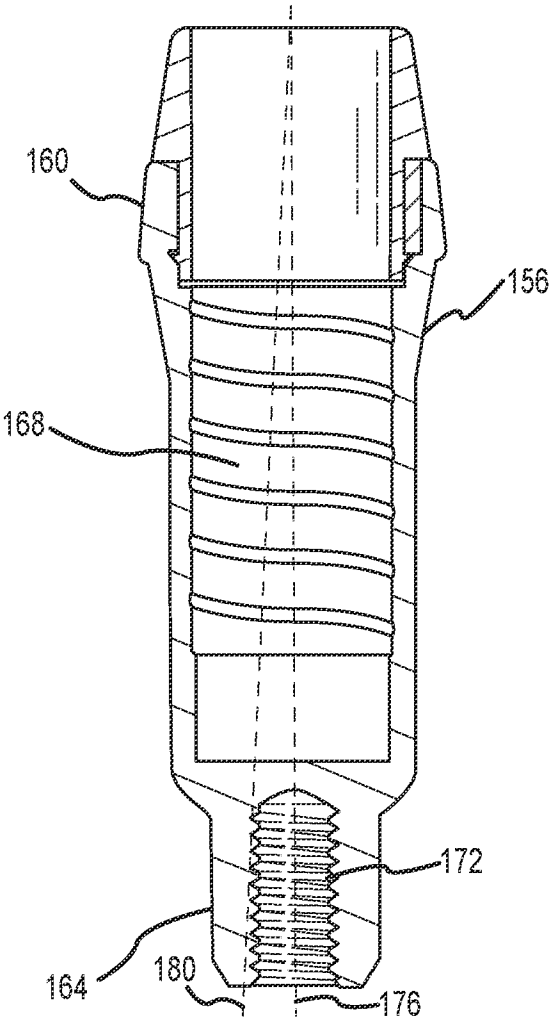
FIG. 3 illustrates a cross sectional view of a shaft sleeve of the golf coupling mechanism of FIG. 1 taken along the hosel bore axis.

Referring to FIGS. 3 and 4, the golf coupling mechanism comprises a shaft sleeve 156 configured to be secured to an end of the shaft 136. The shaft sleeve 156 can be cylindrical or tubular in shape. The shaft sleeve 156 comprises a top section having a top end 160 and a bottom section having a bottom end 164, wherein the bottom end 164 is nearest the sole 120 of the club head 100. The shaft sleeve 156 comprises a widened portion at the top end 160, wherein an external diameter of the shaft sleeve 156 is greater than an internal diameter of the hosel bore 140. The shaft sleeve 156 further defines a top end bore 168 and a bottom end bore 172, wherein the top end bore 168 comprises an internal diameter greater than an internal diameter of the bottom end bore 172. The top end bore 168 of the shaft sleeve 156 is configured to receive the shaft 136. The bottom end bore 172 of the shaft sleeve 156 can be configured to threadably engage with the fastener 152.

The top end bore 168 of the shaft sleeve 156 comprises a sleeve axis 176 extending along a centerline of the shaft sleeve 156 in a direction from the sleeve top end 160 to the sleeve bottom end 164. The hosel bore 140 comprises a hosel bore axis 180 extending along a centerline of the hosel bore 140. The sleeve axis 176 can be angled or tilted with respect to the hosel bore axis 180. The sleeve axis 176 can be angled between 0.4 degrees to 2.5 degrees relative to the hosel bore axis 180. In some embodiments, the sleeve axis 176 can be angled between 0.4 to 1.5 degrees or 1.5 to 2.5 degrees relative to the hosel bore axis 180. For example, the sleeve axis 176 can be angled 0.4, 0.5, 0.6, 0.8, 0.9, 1.0, 1.1, 1.2, 1.22, 1.3, 1.4, 1.5, 1.6, 1.7, 1.8, 1.9, 2.0, 2.1, 2.2, 2.3, 2.4, or 2.5 degrees relative to hosel bore axis 180. The top end bore 168 of the shaft sleeve 156 can be non-concentric with the hosel bore 140.

The sleeve axis 176 being angled from the hosel bore axis 180 enables the shaft sleeve 156, when rotated within the hosel 132, to vary the loft angle and lie angle of the club head 100. The club head 100 using the golf coupling mechanism has two degrees of freedom, wherein the shaft sleeve 156 can tilt forward and backward (i.e. strikeface 108 to rear 112 direction, or vice versa) to vary the loft angle, and the shaft sleeve 156 can tilt left and right (i.e. heel to toe direction, or vice versa) to vary the lie angle. The rotation of the shaft sleeve 156 within the hosel 132 can adjust the loft angle and the lie angle together.

The shaft sleeve 156 can comprise a coupler set 184 having a plurality of sleeve couplers protruding from an outer surface of the shaft sleeve 156. The coupler set 184 of the shaft sleeve 156 can protrude from the outer surface near the top end 160 of the shaft sleeve 156. As illustrated in FIG. 4, the coupler set 184 of the shaft sleeve 156 forms alternating concave and convex surfaces about the cylindrical outer surface of the shaft sleeve 156.

The sleeve couplers of the sleeve coupler set 184 can comprise arcuate surfaces configured to restrict rotation of the shaft sleeve 156 and the shaft 136 relative to the club head 100. The sleeve couplers of the sleeve coupler set 184 can be complimentary to the receiver couplers of the receiver coupler set 188 as described below. As illustrated in FIG. 4, each sleeve coupler of the sleeve coupler set 184 can comprise arcuate surfaces curved throughout the entire coupler. Each sleeve coupler of the sleeve coupler set 184 can comprise a horizontal radius of curvature extending generally in a heel to toe direction, and a vertical radius of curvature extending in a direction from the sleeve top end 160 to the sleeve bottom end 164.

The sleeve coupler set 184 of the shaft sleeve 156 can comprise at least four sleeve couplers. The sleeve coupler set 184 of the shaft sleeve 156 can comprise a first sleeve coupler, a second sleeve coupler, a third sleeve coupler, and a sleeve fourth coupler. The sleeve coupler set 184 of the shaft sleeve 156 can further comprise a sleeve fifth coupler, a sixth sleeve coupler, a seventh sleeve coupler, and an eighth sleeve coupler.

Figure 5:
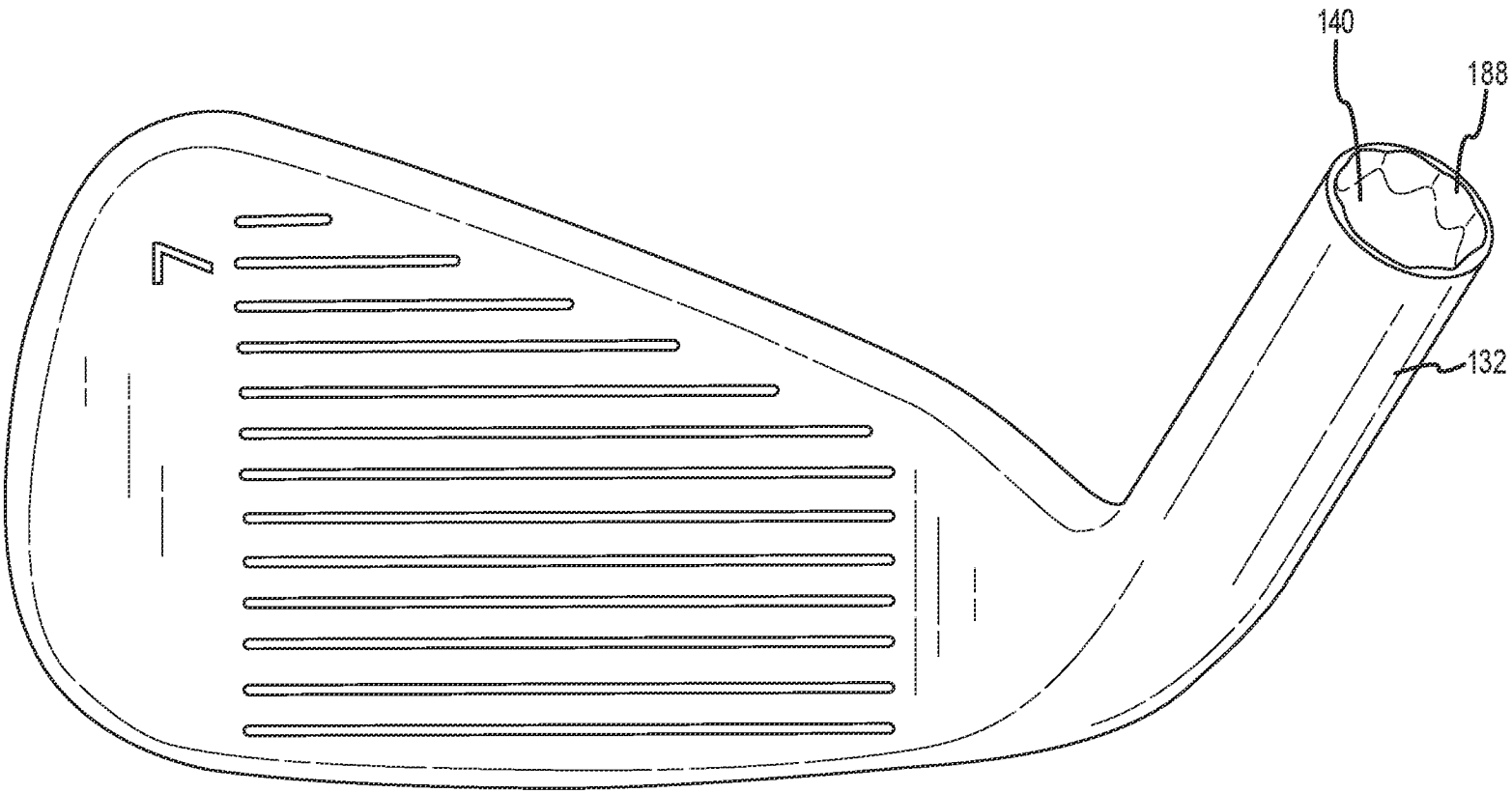
FIG. 5 illustrates a top perspective view of a hosel of golf club head devoid of the golf coupling mechanism of FIG. 1.

Referring to FIG. 5, the hosel bore 140 can comprise a receiver coupler set 188 having a plurality of receiver couplers indented into the internal surface of the hosel 132. The receiver couplers of the receiver coupler set 188 can be complementary to the sleeve couplers of the sleeve coupler set 184 described above. The receiver couplers of the receiver coupler set 188 can comprise arcuate surfaces complementary to the arcuate surfaces of the sleeve coupler set 184 of shaft sleeve 156. Each receiver coupler of the receiver coupler set 188 can comprise arcuate surfaces curved throughout the entire receiver coupler. Each receiver coupler of the receiver coupler set 188 can comprise a horizontal radius of curvature and a vertical radius of curvature similar to each coupler of the coupler set 184.

The receiver coupler set 188 of the hosel bore 140 can comprise at least four receiver couplers. The receiver coupler set 188 of the hosel bore 140 can comprise a first receiver coupler, a second receiver coupler, a third receiver coupler, and a fourth receiver coupler. The receiver coupler set 188 of the hosel bore 140 can further comprise a fifth receiver coupler, a sixth receiver coupler, a seventh receiver coupler, and an eighth receiver coupler.

In some embodiments, the sleeve couplers of sleeve coupler set 184 can be asymmetric about the outer surface of the shaft sleeve 156 such that one or more sleeve couplers are longer in length at a first area of the shaft sleeve 156 (i.e. coupler length measured in a sleeve top end 160 to sleeve bottom end 164 direction) than a second area of the shaft sleeve 156 (e.g. 90 degrees or 180 degrees away from the first area). The receiver couplers of the receiver coupler set 188 can be complementary to the asymmetric profile of the sleeve couplers of the sleeve coupler set 184.

The arcuate surfaces of the sleeve coupler set 184 and the receiver coupler set 188 can be configured to be continuously curved, such as to be devoid of inflection points or edges. The edgeless design of the sleeve couplers from the coupler set 184 and the receiver coupler set 188 maximizes the contact surface area between the couplers when the sleeve coupler set 184 sits against the receiver coupler set 188. Maximizing the contact surface area between the coupler sets allows forces during golf swings to be evenly distributed across the couplers. Even force distribution across the couplers minimizes high localized stress concentrations and increases the durability of the golf coupling mechanism 104. The contact of the sleeve couplers between the coupler set 184 and the receiver coupler set 188 frictionally locks and restricts rotation of the shaft sleeve 156 relative to the club head 100 thereby restricting rotation between the shaft 136 and the club head 100.

Figure 7:
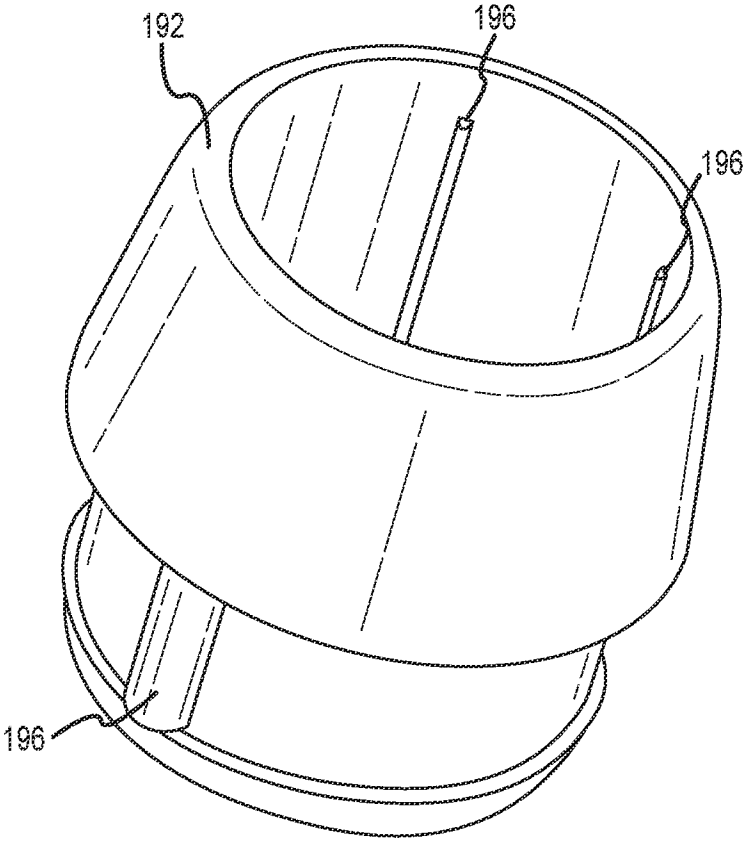
FIG. 7 illustrates a top perspective view of the shaft cap of the golf coupling mechanism of FIG. 1.
Figure 6:
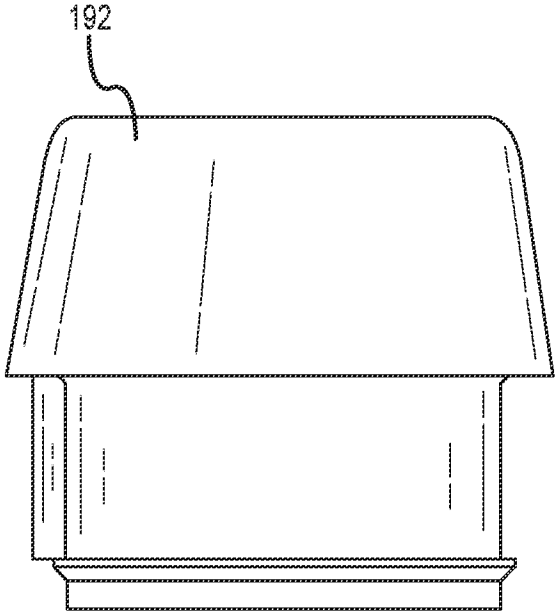
FIG. 6 illustrates a side perspective view of a shaft cap of the golf coupling mechanism of FIG. 1.

Referring to FIGS. 6 and 7, the golf coupling mechanism 104 comprises a shaft sleeve cap 192 configured to couple with the top end 160 of the shaft sleeve 156. The shaft sleeve cap 192 can be configured to elastically compress to be secured within the shaft sleeve 156. The shaft sleeve cap 192 is configured to act like a "shaft pillow" to soften the interaction between the golf coupling mechanism 104 and the shaft 136.

With continued reference to FIGS. 6 and 7, the shaft sleeve cap 192 can comprise centering features such as ribs or protrusions 196 to facilitate the concentricity of the shaft 136 within the shaft sleeve 156. For example, the shaft sleeve cap 192 can comprise protrusions 196 on an inner surface of the shaft sleeve cap 192. In another example, the shaft sleeve cap 192 can comprise an outer protrusion 196 extending outward from an outer surface of shaft sleeve cap 192. The shaft sleeve 156 can comprise a complementary receiving groove (not shown), wherein the receiving groove can be configured to receive the protrusion 196 when the shaft sleeve cap 192 is secured to the shaft sleeve 156.

Figure 8:
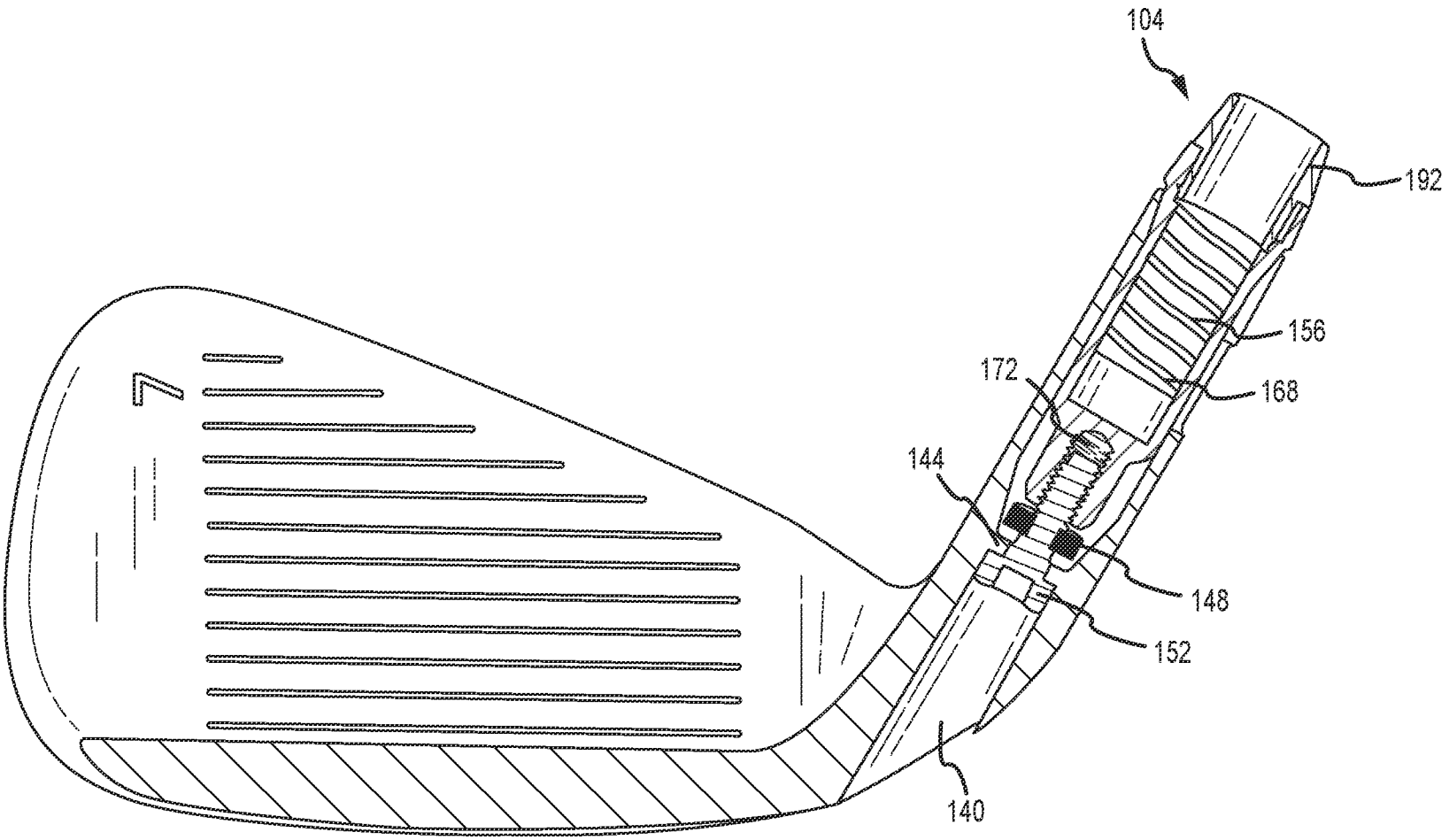
FIG. 8 illustrates a cross sectional view of the golf coupling mechanism of FIG. 1 taken along a hosel bore axis.

Referring to FIG. 8, assembly of the golf coupling mechanism 104 can be completed prior to installing the shaft 136 within the hosel 132. The shaft cap 192 is inserted within the top end bore 168 of the shaft sleeve 156. The assembly comprising the shaft cap 192 and the shaft sleeve 156 is placed within the hosel bore 140 and twisted in the desired position, wherein the sleeve coupler set 184 of the shaft sleeve 156 sits against or abuts the receiver coupler set 188 of the hosel 132. The assembly comprising the shaft cap 192 and the shaft sleeve 156 is secured within the hosel 132 by the retaining assembly comprising the washer 148 and the fastener 152. The fastener 152 threadably engages the bottom end bore 172 of the shaft sleeve 156. A tool such as a torque-limiting tool can be used to tighten the retaining assembly. The retaining assembly comprising the washer 148 and the fastener 152 abuts the hosel flange 144 when tightening the fastener 152. Tightening the fastener 152 pulls the golf coupling mechanism 104 downward towards the sole 120 of the club head 100 to retain the shaft sleeve 156 within the hosel 132.

To adjust the loft angle and the lie angle of the club head 100, a golf fitter begins by using the torque-limiting tool to loosen the fastener 152. The fastener 152 does not need to be removed entirely from the hosel bore 140. Once the fastener 152 is loosened enough, the golf coupling mechanism 104 can be slightly lifted from its position within the hosel 132 and rotated. The golf fitter can rotate the golf coupling mechanism 104 to a desired lie angle setting indicator (as described in more detail below). Once the desired lie angle setting is selected, the golf coupling mechanism 104 can then be reseated within the hosel bore 140 and the fastener 152 can be tighten to secure golf coupling mechanism 104 within the hosel 132. The shaft 136 does not need to be removed from the golf coupling mechanism 104 to adjust loft and lie settings.

The golf coupling mechanism 104 can adjust the loft angle by 0.2 degrees to 2.0 degrees, and the lie angle by 0.5 degrees to 1.5 degrees. For example, the golf coupling mechanism 104 can adjust the loft angle by 0.2, 0.25, 0.3, 0.33, 0.4, 0.5, 0.6, 0.7, 0.8, 0.85, 0.88, 0.89, 0.9, 1.0, 1.1, 1.2, 1.22, 1.3, 1.4, 1.5, 1.6, 1.7, 1.8, 1.9, or 2.0 degrees. For example, the golf coupling mechanism 104 can adjust the lie angle by 0.5, 0.6, 0.7, 0.8, 0.81, 0.85, 0.89, 0.9, 1.0, 1.1, 1.2, 1.22, 1.3, 1.4, or 1.5 degrees.

The golf coupling mechanism 104 can comprise five settings: three weak loft angle settings (i.e. greater loft angle), and two strong loft angle settings (i.e. lower loft angle). In one example, the sleeve axis 176 can be angled 1.22 degrees away from the hosel bore axis 180. A neutral position of the golf coupling mechanism 104 can occur when the sleeve axis 176 is in line with a loft plane (i.e. a plane that is tangent to the strikeface 108). The neutral position can be the first weak loft angle setting, where the golf coupling mechanism 104 does not change the factory made loft and lie angle of the club head 100. The adjustments to the different weak loft angle settings starts from the neutral setting. The second weak loft angle setting occurs when the golf coupling mechanism 104 is rotated 45 degrees in a first direction to achieve a 0.33 degree loft angle decrease and a 0.89 degree lie angle increase. The third weak loft angle setting occurs when the golf coupling mechanism 104 is rotated 45 degrees in a second direction, opposite the first direction, to achieve a 0.33 degree decrease in loft angle and a 0.89 decrease in lie angle. In this example, the weak loft angle settings can adjust the loft angle and lie angle by less than 1 degree.

The adjustments to the different strong loft angle settings starts from the neutral setting. The first strong loft angle setting occurs when the golf coupling mechanism 104 is rotated 90 degrees in the first direction to achieve a 1.22 degree loft angle decrease and a 1.22 lie angle increase. The second strong loft angle setting occurs when the golf coupling mechanism 104 is rotated 90 degrees in the second direction to achieve a 1.22 loft angle decrease and a 1.22 lie angle decrease. In this example, the strong loft angle settings can adjust the loft angle and the lie angle by greater than 1 degree.

Figure 9:
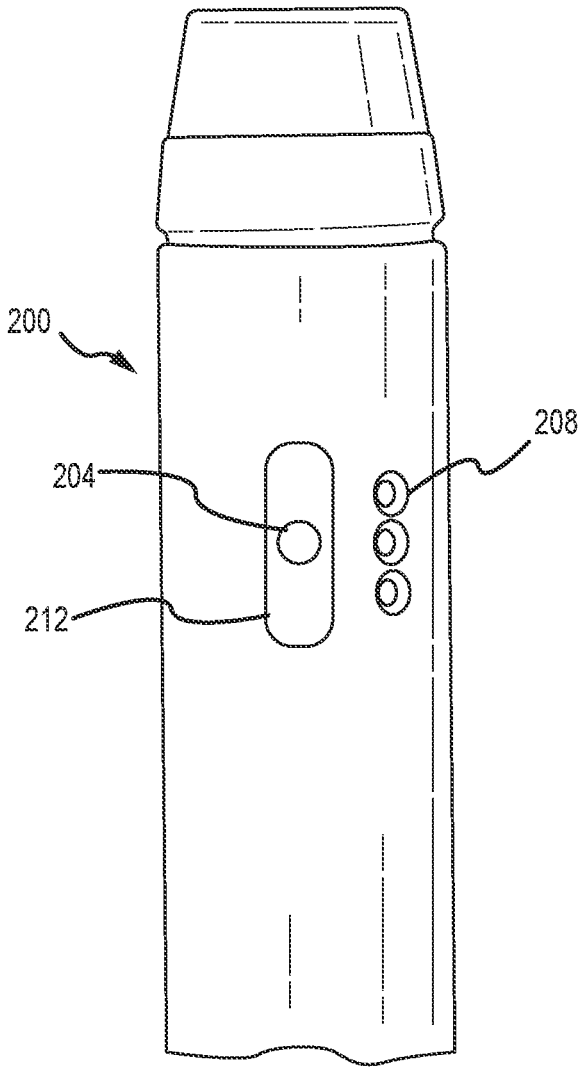
FIG. 9 illustrates a side perspective view of an indicator system for the golf coupling mechanism of FIG. 1.

Referring to FIG. 9, the golf coupling mechanism 104 can further comprise an indicator system 200 to indicate the lie angle of the club head 100. The indicator system 200 can comprise a plurality of sleeve indicators 204 disposed on the outer surface of the shaft sleeve 156, a plurality of hosel indicators 208 disposed on an outer surface of the hosel 132, and a viewing window 212. The viewing window 212 can be formed by removing material from the hosel 132 during the casting manufacturing process. The viewing window 212 can comprise a square-like or rectangular like shape. A topmost end and a bottommost end of the viewing window 212 can be rounded or comprise a radius of curvature. The indicator system 212 allows the golf fitter to identify a lie angle setting for the club head 100.

With continued reference to FIG. 9, the plurality of indicators 208 disposed on the hosel 132 can be arranged in a vertical orientation. In one embodiment, three hosel indicators 208 can be arranged in the vertical orientation. In reference to the three weak loft angle settings described above, the first weak loft or neutral setting occurs when a sleeve indicator 204 aligns with the central or middle hosel indicator 208. The second weak loft angle setting occurs when a sleeve indicator 204 aligns with the topmost hosel indicator 208. Alignment with the topmost hosel indicator 208 can indicate an upright configuration for the club head 100 (i.e. the second weak loft angle setting increases the lie angle). The third weak loft angle setting occurs when a sleeve indicator 204 aligns with the bottommost hosel indicator 208. Alignment with the bottommost hosel indicator 208 can indicate a flat configuration for the club head 100 (i.e. the third weak loft angle setting decreases the lie angle).

In reference to the two strong loft angle settings described above, the first strong loft angle setting occurs when a sleeve indicator 204 aligns with the topmost hosel indicator 208. The first strong loft angle setting allows for a strong loft angle configuration with an upright lie angle configuration. The second strong loft angle setting occurs when a sleeve indicator 205 algins with the bottommost hosel indicator 208. The second strong loft angle setting allows for a strong angle configuration with a flat lie angle configuration.

Golf Coupling Mechanism with Length Adjustment

The golf coupling mechanism 104 allows for the adjustment of a club head loft angle, a club head lie angle, and a golf club shaft length while utilizing one shaft. To achieve adjustments in loft and lie angle, as described above, the golf coupling mechanism 104 includes the shaft sleeve 156 having an off-axis tilt within the top end bore 168 and an asymmetric sleeve coupler set 184. The off-axis tilt and the asymmetric sleeve coupler set 184 enables the shaft sleeve 136, when rotated within the hosel 132, to have two degrees of freedom. To achieve adjustments in a length of the shaft 136, the golf coupling mechanism 104 further includes shaft lengthening components such as a removable spacer and a removable extender. The removable spacer and the removable extender enable the shaft sleeve 156 to have a third degree of freedom (i.e. extending and retracting within the hosel bore 140). The removable spacer and the removable extender control the lengthening of the shaft 136. The golf coupling mechanism 104 having the shaft lengthening components increases or decreases the shaft length while utilizing one shaft.

As described in more detail below, the removable spacer and the removable extender increase the length of the golf coupling mechanism 104 thereby increasing the length of the shaft 136. The removable spacer can comprise one or more coupler sets having a plurality of couplers similar to the sleeve coupler set 184 of the shaft sleeve 156 and the receiver coupler set 188 of the hosel 132. The one or more coupler sets of the removable spacer ensures the golf coupling mechanism 104 frictionally locks the shaft 136 relative to the club head 100 in a lengthen configuration. The removable extender comprises one or more engagement members that interlock with shaft sleeve 156. The one or more engagement members of the removable extender can non-threadably secure the removable extender to the shaft sleeve 156. The non-threaded connection between the removal extender and the shaft sleeve 156 eases the removal of the shaft lengthening components from the golf coupling mechanism 104 to adjust loft angle, lie angle, and shaft length.

Figure 10:
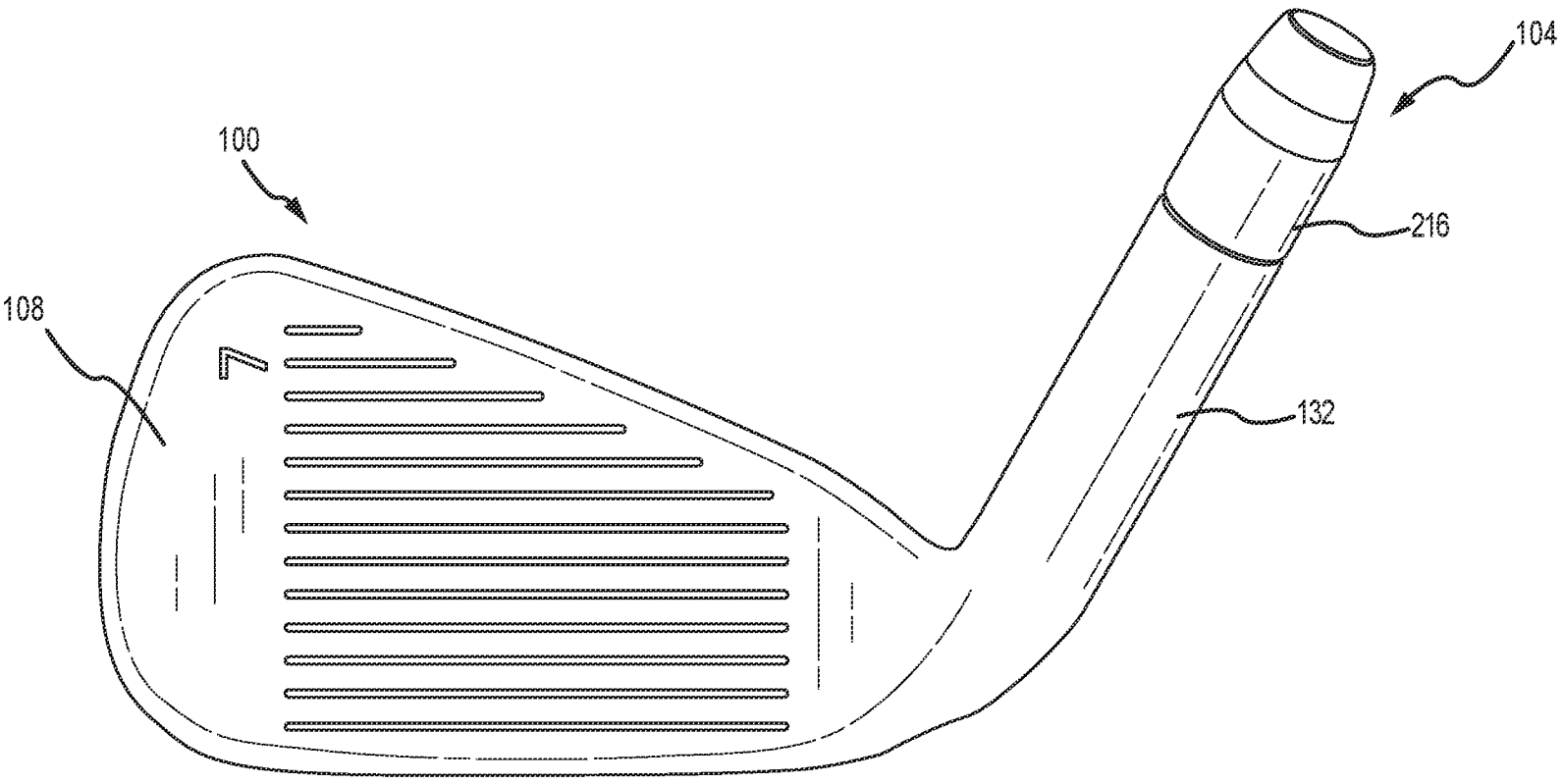
FIG. 10 illustrates a front view of the golf club head of FIG. 1 having the golf coupling mechanism with shaft lengthening components.
Figure 11:
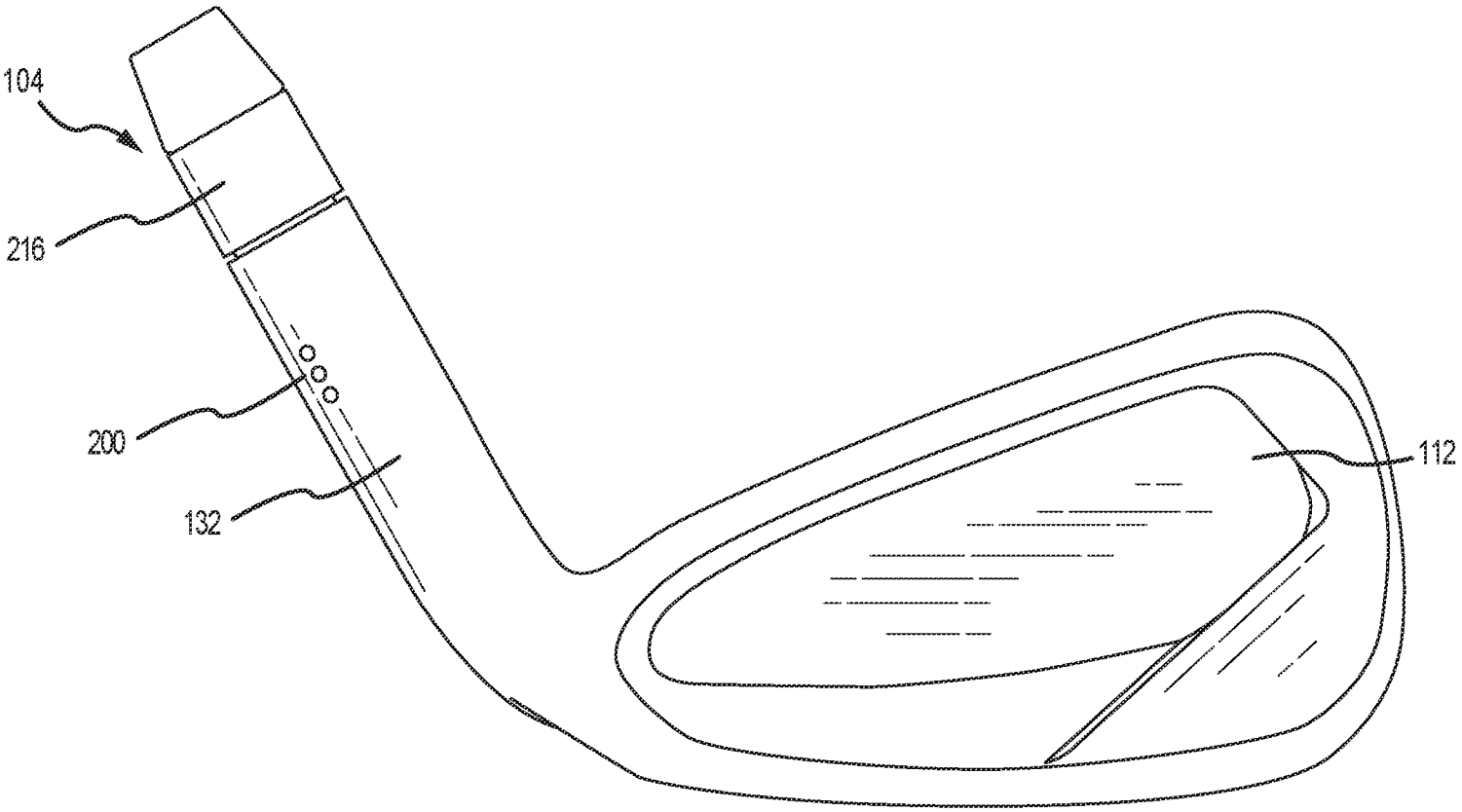
FIG. 11 illustrates a rear view of the golf coupling mechanism of FIG. 1 having the golf coupling mechanism with shaft lengthening components.
Figure 12:
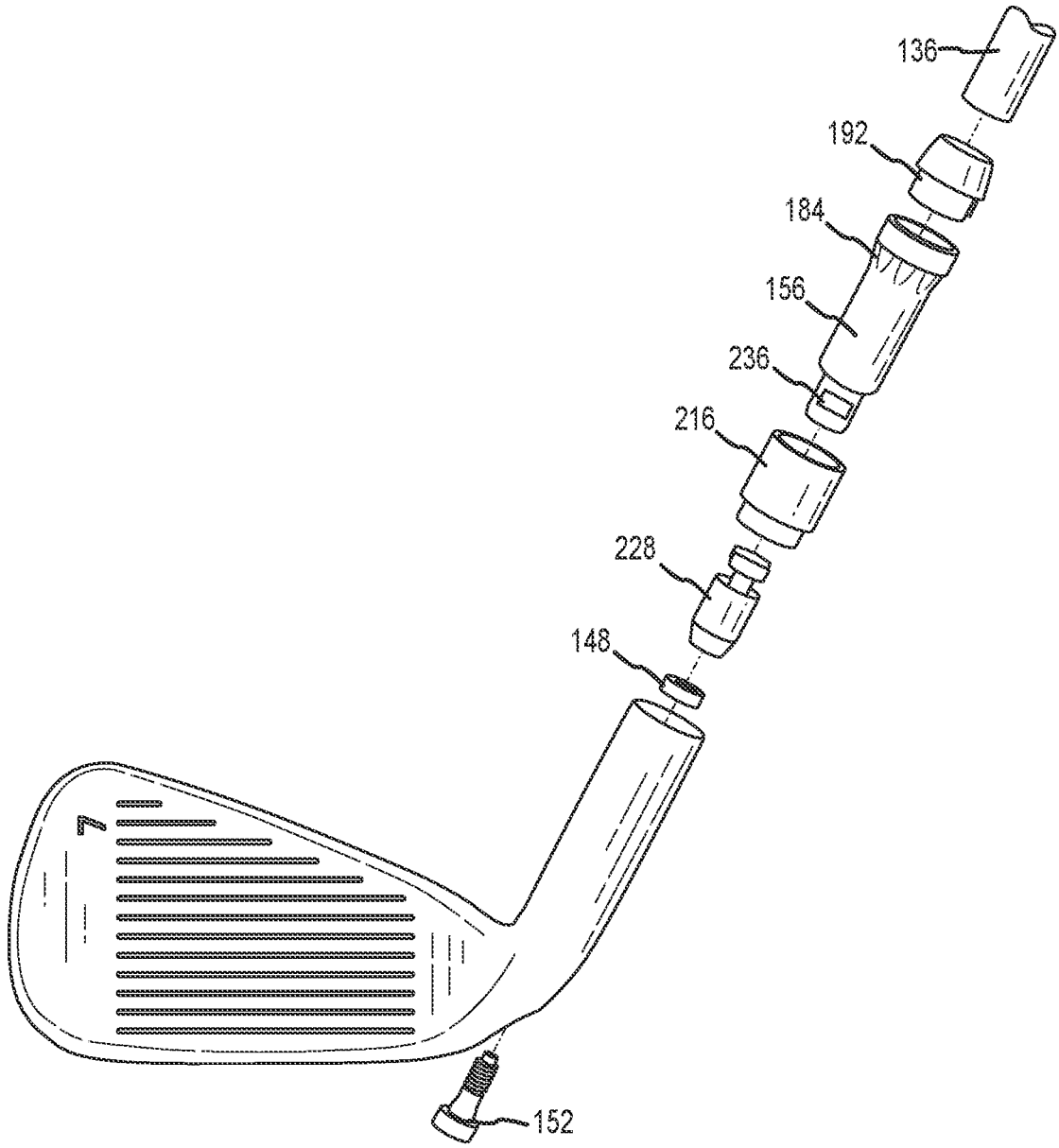
FIG. 12 illustrates an exploded view of the golf coupling mechanism having shaft lengthening components.

Referring to FIGS. 10-12, the golf coupling mechanism 104 can further comprise a removable spacer 216. The removable spacer 216 can be configured to couple with the shaft sleeve 156 near the top end 160. The removable spacer 216 can be configured to abut against the hosel 132 and be located outside or exterior the hosel 132 when the golf coupling mechanism 104 is secured within the hosel 132. The removable spacer 216 can comprise an external diameter greater than the internal diameter of the hosel bore 140.

Figure 13:
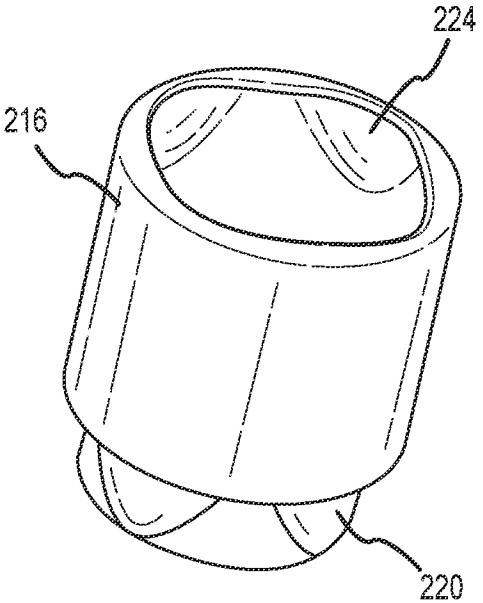
FIG. 13 illustrates a top perspective view of a removable spacer of the golf coupling mechanism.

Referring to FIG. 13, the removable spacer 216 can comprise a coupler set 220 having a plurality of couplers protruding from an outer surface of the spacer 216. The coupler set 220 of the removable spacer 216 can be similar in shape, quantity, and profile as the sleeve coupler set 184 of the shaft sleeve 156. The coupler set 220 of the removable spacer 216 can be configured to sit against and compliment the receiver coupler set 188 of the hosel 132.

With continued reference to FIG. 13, the removable spacer 216 can comprise a receiver coupler set 224 having a plurality of couplers indented into an internal surface of the removable spacer 216. The receiver coupler set 224 of the removable spacer 216 can be similar in shape, quantity, and profile as the receiver coupler set 188 of the hosel 132. The receiver coupler set 224 of the removable spacer 216 can be configured to sit against and compliment the sleeve coupler set 184 of the shaft sleeve 156.

Referring to FIGS. 12-15, the golf coupling mechanism 104 can further comprise a removable extender 228. The removable extender 228 can be configured to engage with the bottom end 164 of the shaft sleeve 156. The removable extender 228 can be completely disposed within the hosel bore 140. The removable extender 228 is not visible when viewing the club head 100 from a point away and outside the club head 100. The removable extender 228 comprises an external diameter less than the internal diameter of the hosel bore 140.

Figure 14:
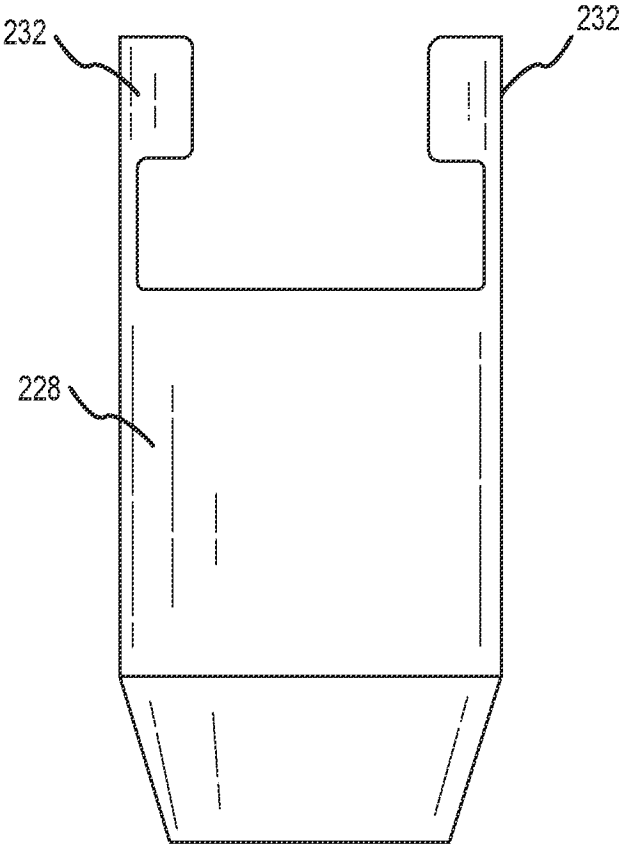
FIG. 14 illustrates a side perspective view of a removable extender of the golf coupling mechanism according to a first embodiment.
Figure 15:
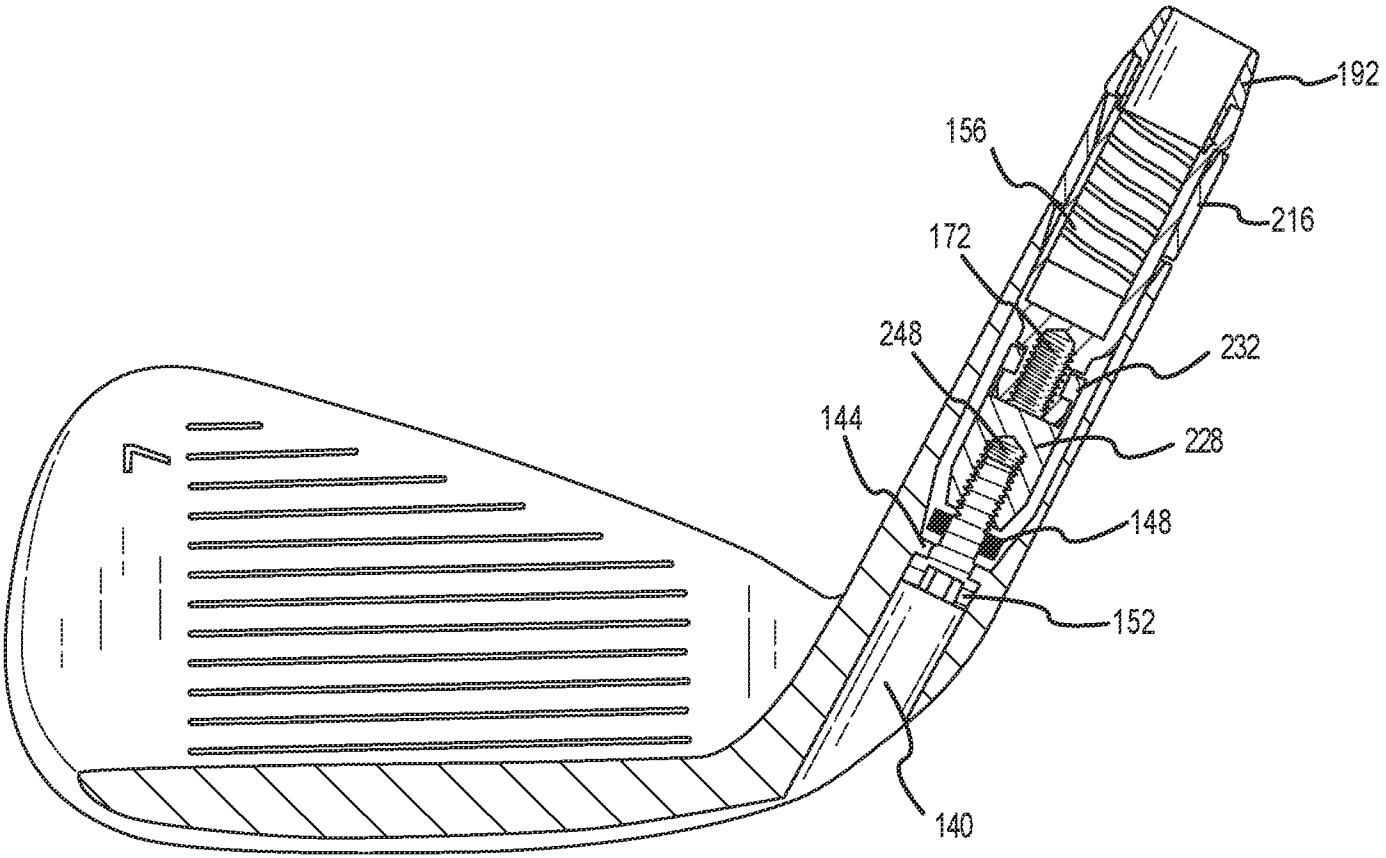
FIG. 15 illustrates a cross sectional view of the golf coupling mechanism with shaft lengthening components taken along the hosel bore axis.

Referring to FIGS. 12, 14, and 15, the removable extender 228 can comprise one or more engagement members 232. In one example, the removable extender 228 can comprise a first engagement member 232 and a second engagement member 232. The first and second engagement member 232 can be features such as protrusions, prongs, hooks, pegs, or features capable of interlocking with the shaft sleeve 156. The first and second engagement member 232 of the removable extender 228 can be configured to interlock with locking channels 236 formed on the shaft sleeve 156. As illustrated in FIGS. 4, 12, and 15, the shaft sleeve 156 comprises a first locking channel 236 and a second locking channel 236 located near the bottom end 164 of the shaft sleeve 156. The first and second engagement member 236 of the removable extender 228 slidably engages the locking channels 236 of the shaft sleeve 156 to ensure the removable extender 228 is secured to the shaft sleeve 156. The interlocking connection between the removable extender 228 and the shaft sleeve 156 can be devoid of threading or a connection that requires the threads.

Figure 16:
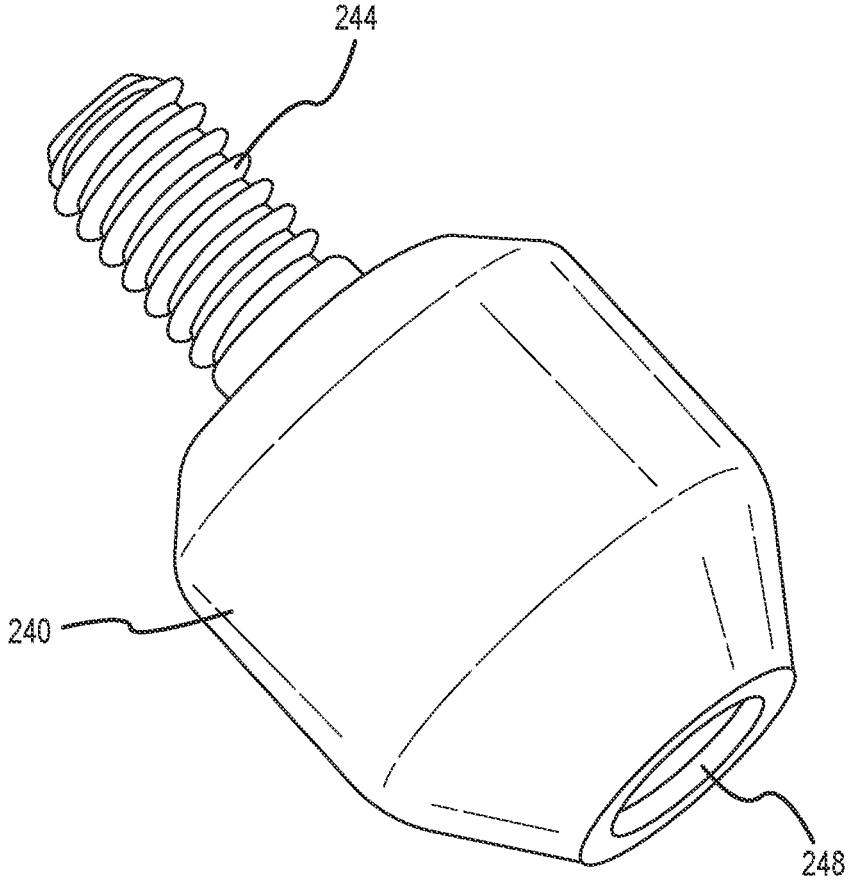
FIG. 16 illustrates a top perspective view of a removable extender of the golf coupling mechanism according to a second embodiment.

In another embodiment, as illustrated in FIG. 16, the golf coupling mechanism 104 can comprise a removable extender 240 having a threaded post 244. The removable extender 240 can be configured to engage with the bottom end 164 of the shaft sleeve 156. The removable extender 240 can be completely disposed within the hosel bore 140. The removable extender 240 can comprise an external diameter less than the internal diameter of the hosel bore 140. In this embodiment, the threaded post 244 of the removable extender 228 can threadably engage with the bottom end bore 172 of the shaft sleeve 156. In this embodiment, a threaded the connection between the removable extender 240 and the shaft sleeve 156 uses threading.

Referring to FIG. 15, assembly of the golf coupling mechanism 104 including the shaft lengthening components such as the removable spacer 216 and the removable extender 228 can be completed prior to installing the shaft 136 within the hosel 132. The shaft cap 192 is inserted within the top end bore 168 of the shaft sleeve 156. The removable spacer 216 is coupled near the top end 160 of the shaft sleeve 156, wherein the sleeve coupler set 184 of the shaft sleeve 156 sits against or abuts the receiver coupler set 224 of the removable spacer 216. The removable extender 228 is engaged to the bottom end 164 of the shaft sleeve 156, wherein the first and second engagement member 232 interlock with the locking channels 236 of the shaft sleeve 156. The assembly comprising the shaft cap 192, the shaft sleeve 156, the removable spacer 216, and the removable extender 228 is disposed within the hosel bore 140 and rotated in the desired position, wherein the spacer coupler set 220 of the removable spacer 216 sits against or abuts the receiver coupler set 188 of the hosel 132. The golf coupling mechanism 104 is then secured within the hosel 132 by the retaining assembly comprising the washer 148 and the fastener 152. The fastener 152 threadably engages with a threaded bore 248 of the removable extender 228. Tightening the fastener 152 pulls the golf coupling mechanism 104 downward towards the sole 120 of the clubhead 100 to allow the golf coupling mechanism 104 to be retained within the hosel 132.

To adjust the length of the shaft 136, a golf fitter begins by using the torque-limiting tool to remove the fastener 152. Once the fastener 152 is removed from the hosel bore 140, the golf coupling mechanism 104 can be removed from the hosel 132. The golf fitter can couple the removable spacer 216 and the removable extender 228 to the shaft sleeve 156. Once the removable spacer 216 and the removable extender 228 are secured to the shaft sleeve 156, the assembled golf coupling mechanism 104 is reseated within the hosel bore 140 and secured with the fastener 152.

The golf coupling mechanism 104 can comprise a kit of multiple spacers 216 and multiple extenders 228 to accommodate a wide range of golfer's heights and wrist to floor measurements. The golf coupling mechanism 104 including the removable spacer 216 and the removable extender 228 can extend the length of the shaft 136 from 0.25 inch to 2.0 inches. In some embodiments, the golf coupling mechanism 104 can increase the length of the shaft 136 from 0.25 to 1.0 inch, or 1.0 to 2.0 inch. For example, the golf coupling mechanism 104 can increase the length of the shaft 136 by 0.25, 0.3, 0.4, 0.5, 0.6, 0.7, 0.8, 0.9, 1.0, 1.1, 1.2, 1.3, 1.4, 1.5, 1.6, 1.7, 1.8, 1.9, or 2.0 inches. A standard or neutral shaft length can be achieved when the golf coupling mechanism 104 is devoid of removable spacer 216 and the removable extender 228. A lengthen shaft 136 can be achieved when the golf coupling mechanism 104 includes the removable spacer 216 and the removable extender 228.

Method of Manufacturing

In many embodiments, a method for forming the club head 100 includes forming the club head 100 with the strikeface 108, the rear 112, the top rail 116, the sole 120, the toe 124, the heel 128, and the hosel 132. In some embodiments, the strikeface 108 can be formed integrally with the club head 100 including the rear 112, the top rail 116, the sole 120, the toe 124, the heel 128, and the hosel 132.

Forming the integral club head 100 can comprise casting, 3D printing, machining, or any other suitable method for forming the club head 100.

In other embodiments, the strikeface 108 can be formed separately from the club head 100. Forming the separate strikeface 108 can comprise machining, 3D printing, casting, or any suitable method for forming the separate strike face 120. In many embodiments, securing the strike face 108 to the club head 100 can be accomplished by welding, mechanical fastening, or any other suitable method of securing the separate strike face 108 to the club head 100.

The club head 100 may be formed from a metal. Examples of metals may include, for example, but not limited to, steel, steel alloy, stainless steel, stainless steel alloy, C300, C350, Ni (Nickel)-Co (Cobalt)-Cr (Chromium)-Steel Alloy, 8620 alloy steel, S25C steel, 303 SS, 17-4 SS, carbon steel, maraging steel, 565 Steel, AISI type 304 or AISI type 630 stainless steel, titanium alloy, Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 titanium alloy, amorphous metal alloy, or other similar metals.

The golf coupling mechanism 104 can be formed from metals or polymeric materials. The shaft sleeve 156, the removable spacer 200, and the removable extender 228 can be formed from aluminum, aluminum alloy, titanium, or titanium alloy. The shaft cap 192 can be formed from a soft material that allows the shaft cap 192 to elastically compress. For example, the shaft cap 192 can comprise a polymer plastic material wherein the polymer plastic material can be a thermoplastic material, or a soft polymer plastic according to the Shore D durometer scale. The soft polymer plastic can be no greater than 40, 45, 50, 55 or 60 on the Shore D durometer scale. The soft polymer plastic can be no greater than 55 on the Shore D durometer scale. The polymer plastic material can be comprised of polystyrene, polyvinyl chloride, nylon, polymethacrylate, rubber, polycarbonate, synthetic rubber or co-polymers thereof.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club comprising: an iron-type club head comprising: a loft angle greater than 28 degrees; and a hosel; and a golf coupling mechanism configured to be inserted into the hosel and configured to couple a golf club shaft with the iron-type club head; wherein: the hosel comprises a hosel bore configured to receive the golf coupling mechanism; the hosel bore comprises a hosel bore axis extending along a centerline of the hose bore; the golf coupling mechanism comprises: a shaft sleeve having a sleeve bore configured to receive an end of the shaft; the shaft sleeve comprising: a sleeve axis extending along a centerline of the sleeve bore; a sleeve coupler set having a plurality of sleeve couplers protruding from an outer surface of the shaft sleeve; the coupler set comprising: a first coupler having an arcuate surface curved throughout the first coupler; a second coupler having an arcuate surface curved throughout the second coupler; a third coupler having an arcuate surface curved throughout the third coupler; and a fourth coupler having an arcuate surface curved throughout the fourth coupler; a shaft cap configured to be inserted into the sleeve bore; the sleeve axis is angled with respect to the hosel bore axis such that the sleeve bore is non-concentric with the hosel bore; and the golf coupling mechanism is configured to be rotated within the hosel to change the loft angle and the lie angle of the iron-type club head.

Clause 2. The golf club of clause 1, wherein: the sleeve coupler set of the shaft sleeve further comprises: a fifth coupler having an arcuate surface curved throughout the fifth coupler; and a sixth coupler having an arcuate surface curved throughout the sixth coupler.

Clause 3. The golf club of clause 2, wherein: the sleeve coupler set of the shaft sleeve further comprises: a seventh coupler having an arcuate surface curved throughout the seventh coupler; and an eighth coupler having an arcuate surface curved throughout the eighth coupler.

Clause 4. The golf club of clause 1, wherein: the hosel bore comprises a receiver coupler set having a plurality of receiver couplers indented into an internal surface of the hosel; the receiver coupler set comprising: a first receiver coupler having an arcuate surface curved throughout the first receiver coupler; a second receiver coupler having an arcuate surface curved throughout the second receiver coupler; a third receiver coupler having an arcuate surface curved throughout the third receiver coupler; and a fourth receiver coupler having an arcuate surface curved throughout the fourth receiver coupler.

Clause 5. The golf club of clause 4, wherein: the receiver coupler set of the hosel bore further comprises: a fifth receiver coupler having an arcuate surface curved throughout the fifth receiver coupler; and a sixth receiver coupler having an arcuate surface curved throughout the sixth receiver coupler.

Clause 6. The golf club of clause 5, wherein: the receiver coupler set of the hosel bore further comprises: a seventh receiver coupler having an arcuate surface curved throughout the sixth receiver coupler; and an eighth receiver coupler having an arcuate surface curved throughout the eighth receiver coupler.

Clause 7. The golf club of clause 4, wherein: the sleeve coupler set of the shaft sleeve is configured to sit against the receiver coupler set of the hosel bore to restrict the rotation of the shaft relative to the iron-type club head.

Clause 8. A golf club comprising: an iron-type club head comprising: a loft angle greater than 28 degrees; and a hosel; and a golf coupling mechanism configured to be inserted into the hosel and configured to couple a golf club shaft with the iron-type club head; wherein: the hosel comprises a hosel bore configured to receive the golf coupling mechanism; the hosel bore comprises a hosel bore axis extending along a centerline of the hosel bore; the golf coupling mechanism comprises: a shaft sleeve having a sleeve bore configured to receive an end of the shaft; the shaft sleeve comprising: a top section; a bottom section; a sleeve coupler set having a plurality of sleeve couplers protruding from an outer surface of the top section; and a sleeve axis extending along a centerline of the sleeve bore; a shaft cap configured to be inserted into the sleeve bore; a removable spacer configured to couple with the top section of the shaft sleeve; and a removable extender configured to couple with the bottom section of the shaft sleeve; the sleeve axis is angled with respect to the hosel bore axis such that the sleeve bore is non-concentric with the hosel bore; and the golf coupling mechanism is configured to be rotated within the hosel to change the loft angle and a lie angle of the iron-type club head; and the golf coupling mechanism is configured to change a length of the golf club shaft.

Clause 9. The golf club of clause 8, wherein: the removable spacer further comprises a receiver coupler set having a plurality of receiver couplers; and the sleeve coupler set of the shaft sleeve is configured to sit against the receiver coupler set of the removable spacer to restrict the rotation of the shaft sleeve relative to the removable spacer.

Clause 10. The golf club of clause 8, wherein the removable spacer further comprises a spacer coupler set having a plurality of spacer couplers protruding from an outer surface of the removable spacer.

Clause 11. The golf club of clause 10, wherein: the hosel bore comprises a receiver coupler set having a plurality of receiver couplers indented into an internal surface of the hosel; and the spacer coupler set of the removable spacer is configured to sit against the receiver coupler set of the hosel bore to restrict the rotation of the golf coupling mechanism relative to the iron-type club head.

Clause 12. The golf club of clause of 8, wherein the shaft sleeve further comprises locking channels located at the bottom section of the shaft sleeve.

Clause 13. The golf club of clause 12, wherein: the removable extender comprises a first engagement member and a second engagement member; and the first and second engagement member of the removable extender are configured to couple with the locking channels of the shaft sleeve to restrict rotation of the removable extender relative to the shaft sleeve.

Clause 14. The golf club of clause 13, wherein removable extender is secured to the shaft sleeve without the use of a threads.

Clause 15. A golf coupling mechanism configured for joining an iron-type club head and a golf club shaft, the golf coupling mechanism comprising: a shaft sleeve having a sleeve bore configured to receive an end of the shaft; the shaft sleeve comprising: a top section; a bottom section; and a sleeve coupler set having a plurality of sleeve couplers protruding from an outer surface of the top section; a shaft cap configured to be inserted into the sleeve bore; a removable spacer configured to couple with the top section of the shaft sleeve; and a removable extender configured to couple with the bottom section of the shaft sleeve; wherein the removable extender is non-threadably secured to the shaft sleeve.

Clause 16. The golf club of clause 15, wherein: the removable spacer further comprises a receiver coupler set having a plurality of receiver couplers; and the sleeve coupler set of the shaft sleeve is configured to sit against the receiver coupler set of the removable spacer to restrict the rotation of the shaft sleeve relative to the removable spacer.

Clause 17. The golf club of clause 15, wherein the removable spacer further comprises a spacer coupler set protruding from an outer surface of the removable spacer.

Clause 18. The golf club of clause of 15, wherein the shaft sleeve further comprises locking channels located at the bottom section of the shaft sleeve.

Clause 19. The golf club of clause 18, wherein: the removable extender comprises a first engagement member and a second engagement member; and the first and second engagement member of the removable extender are configured to couple with the locking channels of the shaft sleeve to restrict rotation of the removable extender relative to the shaft sleeve.

Clause 20. The golf club of clause 15, wherein the shaft cap comprises a plurality of ribs protruding from an internal surface of the shaft cap; wherein plurality of ribs of the shaft cap are configured to center the shaft within the shaft sleeve of the golf coupling mechanism.

Various features and advantages of the disclosure are set forth in the following claims.

The invention claimed is:

1. A golf club coupling mechanism configured for joining an iron-type club head and a golf club shaft, the golf club coupling mechanism comprising:

a shaft sleeve having a sleeve bore configured to receive an end of the golf club shaft; the shaft sleeve comprising:

a top section;

a bottom section; and a sleeve coupler set having a plurality of sleeve couplers protruding from an outer surface of the top section; the sleeve coupler set comprising:

a first coupler having an arcuate surface curved throughout the first coupler;

a second coupler having an arcuate surface curved throughout the second coupler;

a third coupler having an arcuate surface curved throughout the third coupler; and a fourth coupler having an arcuate surface curved throughout the fourth coupler;

a shaft cap configured to be inserted into the sleeve bore;

a removable spacer configured to couple with the top section of the shaft sleeve; and a removable extender configured to couple with the bottom section of the shaft sleeve;

wherein the removable extender is non-threadably secured to the shaft sleeve.

2. The golf club coupling mechanism of claim 1, wherein:

the sleeve coupler set of the shaft sleeve further comprises:

a fifth coupler having an arcuate surface curved throughout the fifth coupler;

a sixth coupler having an arcuate surface curved throughout the sixth coupler;

a seventh coupler having an arcuate surface curved throughout the seventh coupler; and an eighth coupler having an arcuate surface curved throughout the eighth coupler.

3. The golf club coupling mechanism of claim 1, wherein:

the removable spacer further comprises a receiver coupler set having a plurality of receiver couplers; and the sleeve coupler set of the shaft sleeve is configured to sit against the receiver coupler set of the removable spacer to restrict a rotation of the shaft sleeve relative to the removable spacer.

4. The golf club coupling mechanism of claim 1, wherein the removable spacer further comprises a spacer coupler set protruding from an outer surface of the removable spacer.

5. The golf club coupling mechanism of claim 1, wherein the shaft sleeve further comprises locking channels located at the bottom section of the shaft sleeve.

6. The golf club coupling mechanism of claim 5, wherein:

the removable extender comprises a first engagement member and a second engagement member; and the first and second engagement members of the removable extender are configured to couple with the locking channels of the shaft sleeve to restrict rotation of the removable extender relative to the shaft sleeve.

7. The golf club coupling mechanism of claim 1, wherein the shaft cap comprises a plurality of protrusions protruding from an internal surface of the shaft cap; wherein the plurality of protrusions of the shaft cap are configured to center the golf club shaft within the shaft sleeve.

8. The golf club coupling mechanism of claim 1, wherein the shaft cap is configured to elastically compress to be secured within the shaft sleeve.

9. The golf club coupling mechanism of claim 1, wherein the sleeve coupler set is asymmetric about an outer surface of the shaft sleeve such that one or more sleeve couplers of the plurality of sleeve couplers are longer in length at a first area of the shaft sleeve than a second area of the shaft sleeve.

10. The golf club coupling mechanism of claim 1, wherein the removable spacer and the removable extender is formed from aluminum alloy.

* * * * *